US007849807B2

(12) United States Patent
Suzuki et al.

(10) Patent No.: US 7,849,807 B2
(45) Date of Patent: Dec. 14, 2010

(54) SEWING MACHINE, SEWING MARK, AND COMPUTER-READABLE RECORDING MEDIUM STORING SEWING MACHINE CONTROL PROGRAM

(75) Inventors: Hiroyuki Suzuki, Nagoya (JP); Motoshi Kishi, Nagoya (JP); Yoshio Sugiura, Nishikamo (JP); Shoichi Taguchi, Nagoya (JP); Masayuki Iwata, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 428 days.

(21) Appl. No.: 12/071,805

(22) Filed: Feb. 26, 2008

(65) Prior Publication Data

US 2008/0216724 A1 Sep. 11, 2008

(30) Foreign Application Priority Data

Mar. 8, 2007 (JP) ..... 2007-057938

(51) Int. Cl.
*D05B 19/02* (2006.01)
*G06F 9/00* (2006.01)

(52) U.S. Cl. ..... 112/470.03; 112/272; 700/137

(58) Field of Classification Search ..... 112/102, 112/102.5, 117, 118, 470.01–470.18, 272, 112/273; 700/130–138
See application file for complete search history.

(56) References Cited

U.S. PATENT DOCUMENTS 4,296,700 A * 10/1981 Jehle et al. ..... 112/153
4,658,741 A * 4/1987 Jehle et al. ..... 112/470.02
5,188,047 A * 2/1993 Rohr et al. ..... 112/470.03
5,838,573 A * 11/1998 Crathern et al. ..... 700/230
6,263,815 B1 * 7/2001 Furudate ..... 112/470.13
6,732,668 B2 * 5/2004 Zesch et al. ..... 112/102.5
6,959,657 B1 * 11/2005 Duval ..... 112/272
2004/0035526 A1 * 2/2004 Chamandy et al. ..... 156/293
2006/0031128 A1 * 2/2006 Lamitie ..... 705/26
2007/0009732 A1 * 1/2007 Tsai et al. ..... 428/349

FOREIGN PATENT DOCUMENTS

CN 1624229 A 6/2005
JP A-09-056963 3/1997
JP A-2005-084954 3/2005
JP A-2005-160936 6/2005

* cited by examiner

*Primary Examiner*—Ismael Izaguirre
(74) *Attorney, Agent, or Firm*—Oliff & Berridge, PLC

(57) ABSTRACT

A sewing machine includes a needle bar to which a sewing needle is attached, a sewing machine motor that drives a needle bar mechanism for vertically driving the needle bar via a drive shaft, an information reading device, and a control device. The information reading device is disposed in the vicinity of a needle drop position of the sewing needle and reads out sewing information relating to sewing conditions for the sewing machine each time a mark attached to a work cloth enters into a communication range as the work cloth is moved, the sewing information being stored in an RFID tag included in the mark. The control device controls sewing based on the sewing information read out by the information reading device from the RFID tag.

11 Claims, 11 Drawing Sheets

FIG. 6

| IDENTIFICATION NUMBER | SEWING PATTERN | NEEDLE BAR SWINGING AMOUNT : Z (mm) | CLOTH FEED DISTANCE : F (mm) | SEWING SPEED |
|---|---|---|---|---|
| 0000 | STOP | 0 | 0 | 0 |
| 0011 | STRAIGHT STITCH (LEFT BASELINE) | 0 | 2.5 | LOW SPEED : 70rpm |
| 0012 | STRAIGHT STITCH (LEFT BASELINE) | 0 | 2.5 | MIDDLE SPEED : 410rpm |
| 0013 | STRAIGHT STITCH (LEFT BASELINE) | 0 | 2.5 | HIGH SPEED : 750rpm |
| 0021 | ZIGZAG STITCH (MIDDLE BASELINE) | 3.5 | 1.4 | LOW SPEED : 70rpm |
| 0022 | ZIGZAG STITCH (MIDDLE BASELINE) | 3.5 | 1.4 | MIDDLE SPEED : 410rpm |
| 0023 | ZIGZAG STITCH (MIDDLE BASELINE) | 3.5 | 1.4 | HIGH SPEED : 750rpm |
| ⋮ | ⋮ | ⋮ | ⋮ | ⋮ |
| XXXX | BLIND STITCH | 0 | 2 | HIGH SPEED : 750rpm |

SEWING MACHINE, SEWING MARK, AND COMPUTER-READABLE RECORDING MEDIUM STORING SEWING MACHINE CONTROL PROGRAM

CROSS-REFERENCE TO RELATED APPLICATION

This application claims priority from Japanese Patent Application No. 2007-057938, filed Mar. 8, 2007, the disclosure of which is hereby incorporated by reference in its entirety.

BACKGROUND

The present disclosure generally relates to technical fields including a sewing machine, a sewing mark, and a computer-readable recording medium storing a sewing machine control program. More specifically, the present disclosure relates to a sewing machine that controls sewing by utilizing a Radio Frequency Identification (RFID) tag, a sewing mark used during sewing by the sewing machine, and a computer-readable recording medium storing a sewing machine control program for controlling the sewing machine.

Conventionally, before sewing a work cloth (a sewing object) with a sewing machine, sewing positions on the work cloth may generally be marked with an erasable sewing pen, a basting thread, dress pins, etc. A user may sew the work cloth using the marks as a guide by following the marks. If necessary, the user of the sewing machine manually changes a sewing speed and a sewing method during sewing, while the user moves the work cloth using the marks on the work cloth as a guide.

Recently, an RFID technology has become widely known, in which an integrated circuit (IC chip) equipped with an antenna is employed. The IC chip with the antenna may be referred to as an "RFID tag", and may be shaped like a tag, a label, or the like. The RFID tag may be added to a variety of products so that information stored in the RFID tag may be read out from the RFID tag or information may be written into the RFID tag, with an apparatus referred to as an "RFID reader/writer". The RFID technology is also utilized in various fields to identify and control individuals. For example, Japanese Patent Application Laid Open Publication No. 2005-160936 discloses an RFID tag that is attached to a work cloth as a sewing object and that stores information to identify the type of the work cloth. It also discloses that a control device of an eyelet buttonholing sewing machine determines whether a pressing pressure and a tension set for the sewing machine are suitable for the type of the work cloth indicated by the identification information of the work cloth read out by an RFID reader/writer of the sewing machine.

SUMMARY

However, in Japanese Patent Application Laid Open Publication No. 2005-160936, the RFID tag attached to the work cloth stores only the identification information about the type of the work cloth. Therefore, although the type of the work cloth may be identified and the accompanying setting of some conditions may be appropriately carried out, the user still needs to select a sewing pattern, change the sewing speed, etc., manually. In particular, a beginner who is not skilled in sewing with a sewing machine may find it difficult to form desired stitches while moving around a work cloth.

Exemplary implementations of the broad principles described herein provide a sewing machine with which a user does not need to change a sewing speed or a sewing setting while sewing so that the user may easily form desired stitches.

Exemplary implementations provide a sewing machine that includes a needle bar to which a sewing needle is attached, a sewing machine motor that drives a needle bar mechanism for vertically driving the needle bar via a drive shaft, an information reading device and a control device. The information reading device is disposed in the vicinity of a needle drop position of the sewing needle and reads out sewing information related to sewing conditions for the sewing machine each time a mark attached to a work cloth enters into a communication range as the work cloth is moved. The sewing information is stored in an RFID tag included in the mark. The control device controls sewing based on the sewing information read out by the information reading device from the RFID tag.

Exemplary implementations also provide a computer-readable recording medium storing a sewing machine control program for a sewing machine. The sewing machine includes a needle bar to which a sewing needle is attached and a sewing machine motor that drives via a drive shaft a needle bar mechanism for vertically driving the needle bar. The program includes instructions for reading out sewing information relating to sewing conditions for the sewing machine each time a mark attached to a work cloth enters into a communication range as the work cloth is moved. The sewing information is stored in an RFID tag included in the mark, and instructions for controlling the sewing based on the sewing information is read out from the RFID tag.

Exemplary implementations further provide a sewing mark that is used for sewing. The sewing machine includes a sewing information reading device that is disposed in the vicinity of a needle drop position of a sewing needle and that reads out sewing information stored in an RFID tag in a communication range and a control device that controls sewing based on the sewing information read out by the sewing information reading device. The sewing mark includes an attachment member that may be attached to and detached from a work cloth to be sewn, and an RFID tag that stores at least the sewing information related to sewing conditions for the sewing machine.

BRIEF DESCRIPTION OF THE DRAWINGS

Exemplary implementations will be described below in detail with reference to the accompanying drawings in which:

FIG. 6 is an explanatory table of sewing information stored in the RFID tag;

DETAILED DESCRIPTION

Figure 1:
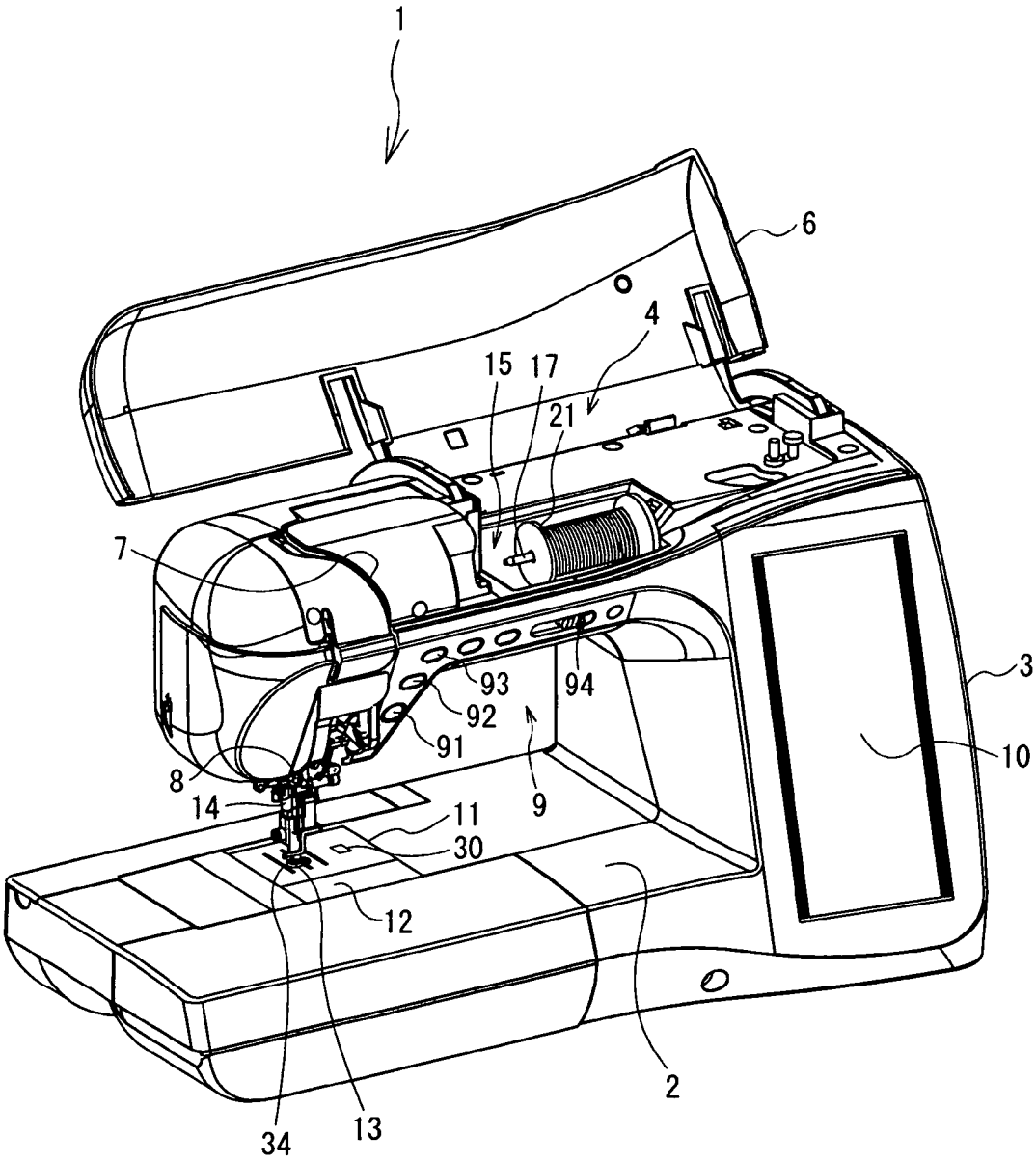
FIG. 1 is a perspective view of a sewing machine.

An example of a sewing machine 1 and a dress pin 50 according to the present disclosure with reference to the drawings is described below. The drawings are a description of technical features that may be employed. The configuration of an apparatus and flowcharts of various processing illustrated in the drawings are not intended to limit the scope of the invention, but are just examples for explanation, unless otherwise specified.

Figure 2:
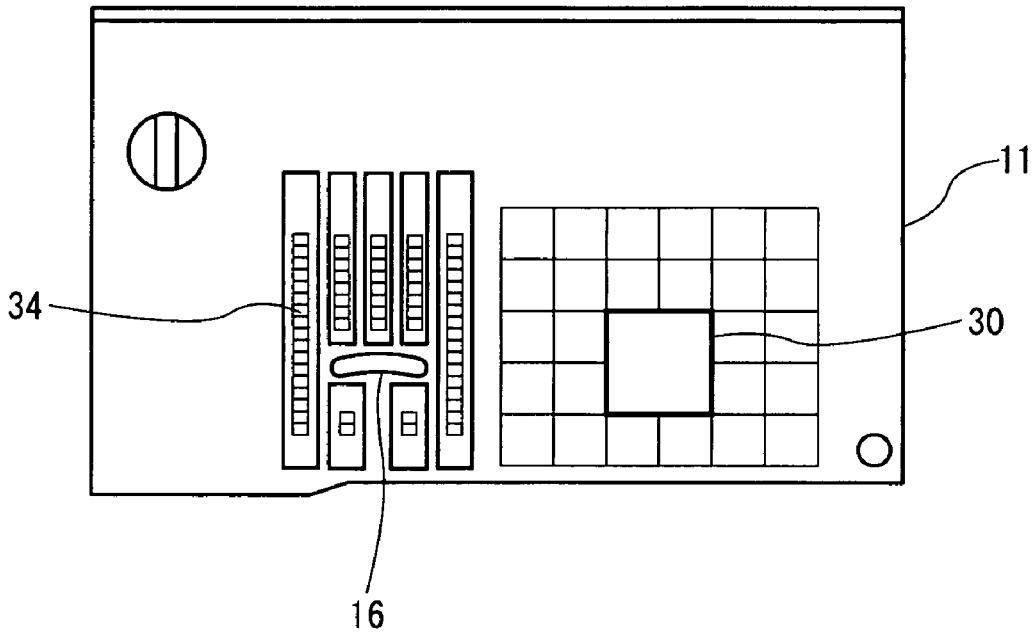
FIG. 2 is a plan view of a needle plate portion of the sewing machine.

First, the physical configuration of the sewing machine 1 will be described below with reference to FIGS. 1 and 2. In FIG. 1, the front side of the paper (closer side to a viewer) is referred to as "the front side of the sewing machine 1" and the rear side of the paper (far side from a viewer) is referred to as "the rear side of the sewing machine 1". And the right and left directions, as viewed from an operator of the sewing machine 1, are respectively referred to as right and left directions of the sewing machine 1. As shown in FIG. 1, the sewing machine 1 may include a bed 2, a pillar 3, and an arm 4. The pillar 3 may be erected perpendicular to the bed 2 at the right end of the bed 2. The arm 4 may extend leftward from the upper end of the pillar 3 in such a manner that the arm 4 may face the bed 2.

The bed 2 may be equipped with a needle plate 11. Under the needle plate 11, a shuttle mechanism (not shown) may be provided. The bed 2 may also be equipped with a slide cover 12. A bobbin (not shown) for a lower thread may be attached to and detached from the shuttle mechanism when the slide cover 12 is slided to open. A feed dog 34, a feeding mechanism (not shown), and a feed adjustment motor 76 (see FIG. 3) may also be provided under the needle plate 11. The feed dog 34 may feed a work cloth, on which a pattern is to be sewn, by a predetermined feed distance. The feed dog 34 may be driven by the feeding mechanism (not shown). The feed adjustment motor 76 may adjust a feed distance for the work cloth. Further, as shown in FIG. 2, an RFID reader 30 may be fitted in the needle plate 11 at the right side of a needle hole 16, which corresponds to a needle drop position. The RFID reader 30 may be used to read sewing information stored in an RFID tag 800 by wireless communication (see FIG. 4). The RFID reader 30 and the RFID tag 800 will be described in detail later.

Under the pillar 3, a sewing machine motor 77 (see FIG. 3) may be mounted. Drive power from the sewing machine motor 77 may be transmitted via a drive belt (not shown) to a pulley (not shown) and a drive shaft (not shown). The drive shaft may extend leftward from the pulley through the arm 4. The drive power from the sewing machine motor 77 may also be transmitted to a lower shaft (not shown) by a transmission mechanism (not shown) mounted along the drive shaft. With such a configuration, a needle bar 8, a thread take-up mechanism (not shown), the shuttle mechanism, the feed dog 34, etc., may be synchronously driven.

As shown in FIG. 1, the pillar 3 may be equipped with a vertically long liquid crystal display (LCD) 10. The LCD 10 may display various messages and function names for various functions performed during the sewing. The functions may include setting and editing of a pattern, for example. The LCD 10 may include a touch panel 111 (see FIG. 3). When an item displayed on the LCD 10 is selected by an operator with a finger or a dedicated pen, the selection of the item is sensed by the touch panel 111. In such a manner, the operator may enter various instructions via the LCD 10. On the right side surface of the pillar 3, a connector 108 (see FIG. 3) may be provided. Via the connector 108, it may be possible to input various kinds of data and programs into the sewing machine 1 or output those data and programs from the sewing machine 1.

The arm 4 may be provided with a cover 6 at its upper part along its whole length in the longitudinal direction. The cover 6 may be pivotally supported at the upper rear part of the arm 4 so that it may be opened and closed around an axis along the longitudinal direction of the arm 4. As shown in FIG. 1, under the cover 6, a spool housing 15, which is a recess, may be provided in the vicinity of the midsection of the upper surface of the arm 4. The spool housing 15 may be used to store a thread spool 21, around which a needle thread is wound. From the right side wall of the spool housing 15, a spool pin 17 may extend parallel to the arm 4. The spool pin 17 may rotatably support the thread spool 21. At the lower part of an end portion of the arm 4, which is opposite to the side where the arm 4 is connected to the pillar 3, a needle bar 8 may be disposed. A sewing needle may be attached to the needle bar 8. Behind the needle bar 8, a presser bar 14 may be provided. The presser bar 14 may have a presser foot 13, which presses a work cloth, at its lower end.

A needle bar mechanism (not shown), a needle bar swinging motor 78 (see FIG. 3), and a thread take-up mechanism (not shown) may also be provided in the end portion of the arm 4. The needle bar mechanism may move the needle bar 8 up and down with the sewing needle. The needle bar swinging motor 78 may be used to swing the needle bar 8 in the right and left direction.

Further, on the front surface of the end portion of the arm 4, a thread guide groove 7 may be formed. The thread guide groove 7 may guide a needle thread pulled out from the thread spool 21 to the sewing needle via a tension mechanism, a thread take-up spring, and a thread take-up lever (all of which are not shown).

On the front surface of the arm 4, a plurality of operation keys 9 may be provided. The operations keys 9 may be used for entering instructions for various sewing operations. The operation keys 9 may include a start/stop key 91, a reverse stitch key 92, a needle up/down key 93, and a speed control lever 94. The sewing start/stop key 91 may be used to start or stop sewing. The reverse stitch key 92 may be used to form a reverse stitch. The needle up/down key 93 may be used to switch the position of the sewing needle between an upper position and a lower position. The speed control lever 94 may be used to set a sewing speed. The speed control lever 94 may also be used to adjust a needle bar swinging amount of a zigzag stitch, for example, when it is set as the needle bar swinging amount adjustment lever by setting key displayed on the LCD 10.

Figure 3:
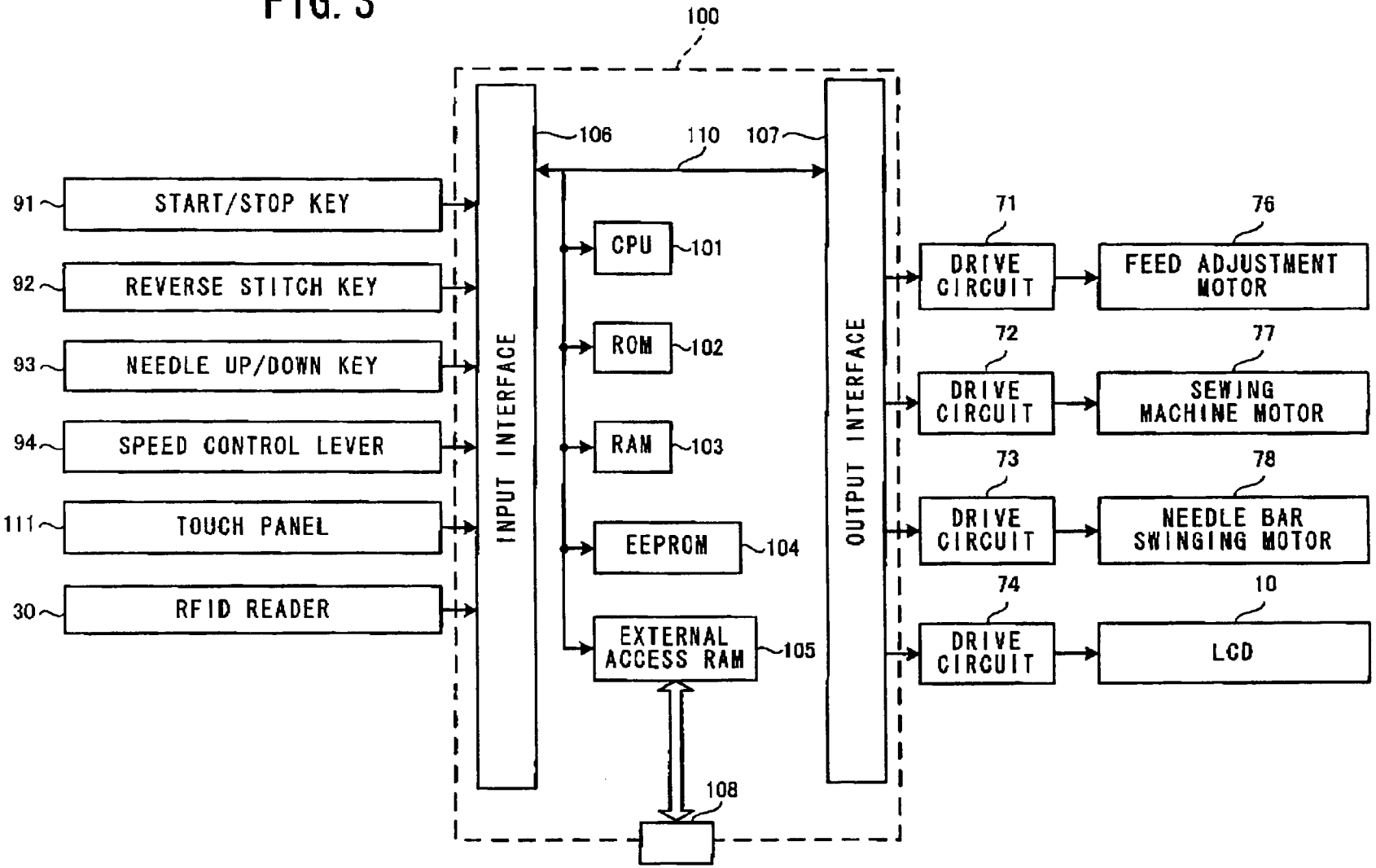
FIG. 3 is a block diagram showing the electrical configuration of the sewing machine.

Next, the electrical configuration of the sewing machine 1 will be described below with reference to FIG. 3. As shown in FIG. 3, the control system of the sewing machine 1 has a control section 100. The control section 100 may include a CPU 101, a ROM 102, a RAM 103, an EEPROM 104, an external access RAM 105, an input interface (I/F) 106, and an output I/F 107, which may be connected to each other via a bus 110. The sewing start/stop key 91, the reverse stitch key 92, the needle up/down key 93, the speed control lever 94, the touch panel 111, and the RFID reader 30 (see FIG. 1) may be connected to the input I/F 106. Drive circuits 71-74 may be connected to the output I/F 107. The drive circuits 71-74 may drive the feed adjustment motor 76, the sewing machine motor 77, the needle bar swinging motor 78, and the LCD 10 (see FIG. 1), respectively. Further, a connector 108 may be connected to the external access RAM 105. Information stored in the external access RAM 105 may be outputted via the connector 108 to the outside of the sewing machine 1.

The CPU 101 in the control section 100 may handle main control of the sewing machine 1 and may perform various computations and processing in accordance with instructions of various programs stored in the ROM 102. The ROM 102, which is a read only memory, may have a program storage area (not shown) for storing the various programs. The RAM 103, which is a random access memory, may have storage areas (not shown) for temporarily storing various kinds of data.

The RFID reader 30 may be any known RFID reader that may perform wireless communication with an RFID tag 800 (see FIGS. 4 and 5) embedded in a dress pin 50 and read out information from the RFID tag 800 without physically contacting the RFID tag 800. Although not illustrated, the configuration of the RFID reader 30 is described below. The RFID reader 30 may include an antenna, a transmission/reception circuit, a signal processing circuit, and a control circuit. The antenna may transmit and receive a signal through wireless communication with an antenna 811 of the RFID tag 800. The transmission/reception circuit may be used to gain access to an IC circuit section 820 of the RFID tag 800 via the antenna, to read or write information. The signal processing circuit may process an information signal read out from the RFID tag 800. The control circuit, which may be a so-called microcomputer, may include a CPU, a ROM, a RAM, etc. The control circuit may process the signal in accordance with the programs stored in the ROM, utilizing the tentative storage areas of the RAM.

Figure 4:
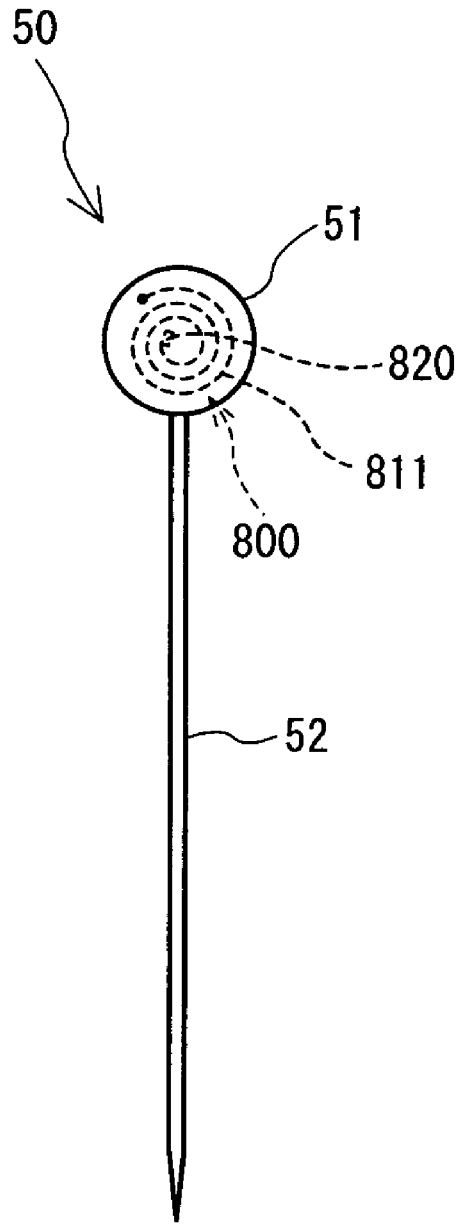
FIG. 4 is a plan view of a dress pin.
Figure 5:
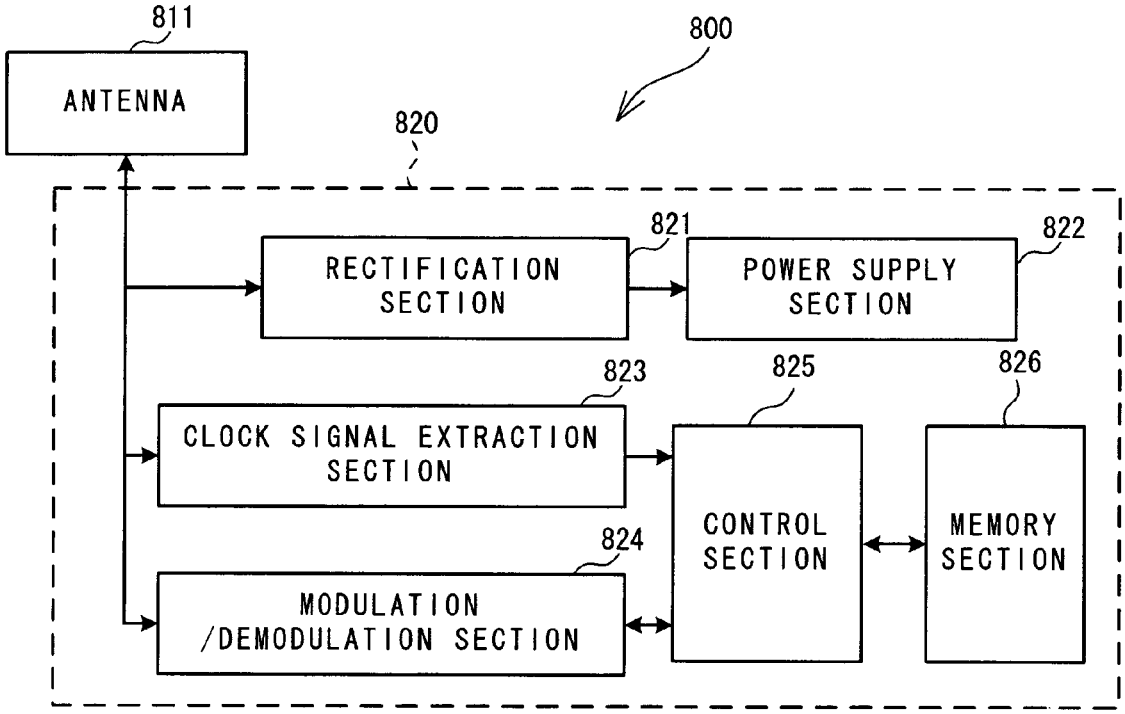
FIG. 5 is a block diagram showing the electrical configuration of an RFID tag.

Next, the dress pin 50, which may be attached to a work cloth, will be described below with reference to FIGS. 4 and 5. First, the physical configuration of the dress pin 50 will be described with reference to FIG. 4. The dress pin 50 may have a head portion 51 and a needle portion 52. The head portion 51 may be shaped like a label, which may be circular as viewed in ground plan. In the head portion 51, the RFID tag 800 (see FIG. 5) may be embedded. One end of the needle portion 52 may be connected to the head portion 51, and the other end may be pointed. The needle portion 52 may be stuck into a work cloth to be secured.

Next, the electrical configuration of the RFID tag 800 will be described below with reference to FIG. 5. As shown in FIG. 4, the RFID tag 800 may include a coil-shaped antenna 811 and an IC circuit section 820 connected to one end of the antenna 811. The antenna 811 may be used to transmit or receive a signal to or from an antenna (not shown) of the RFID reader 30 without physically contacting the RFID reader 30, using radio waves. The IC circuit section 820 may include a rectification section 821 connected to the antenna 18, a power supply section 822 connected to the rectification section 821, a clock signal extraction section 823 connected to the antenna 811, a modulation/demodulation section 824 connected to the antenna 811, a control section 825 connected to the clock signal extraction section 823 and the modulation/demodulation section 824, and a memory section 826 connected to the control section 825. The rectification section 821 may rectify a carrier wave received by the antenna 811. The power supply section 822 may accumulate the energy of the carrier waves rectified by the rectification section 821 and utilize the energy as drive power. The clock signal extraction section 823 may extract a clock signal from the carrier wave received by the antenna 811 and may supply the extracted clock signal to the control section 825. The modulation/demodulation section 824 may demodulate a signal transmitted in the carrier wave from the RFID reader 30 and a signal received by the antenna 811 and, further, may modulate and reflect the carrier wave received by the antenna 811, based on a response signal from the control section 825. The control section 825 may control the basic operations of the RFID tag 800. For example, the control section 825 may interpret a demodulated signal received from the modulation/demodulation section 824, generate a response signal based on information stored in the memory section 826, and return a signal via the modulation/demodulation section 824, etc. The memory section 826 may store predetermined information. In an exemplary implementation, sewing information may be stored in the memory section 826. The RFID tag 800 of an exemplary implementation may return a signal based on the sewing information in response to an interrogation signal from the RFID reader 30. In such a manner, the RFID reader 30 may read out the sewing information.

Now, the sewing information stored in the memory section 826 of the RFID tag 800 will be described below with reference to FIG. 6. As shown in FIG. 6, the sewing information may include data pieces that represent an identification number, a sewing pattern, a needle bar swinging amount, a cloth feed distance, and a sewing speed. The identification number may be predetermined for each type of the sewing information to be stored. The needle bar swinging amount may indicate a swinging width of the needle bar 8 in the right and left direction, which corresponds to the width of a stitch. The cloth feed distance may indicate a distance by which a work cloth is fed by the feed dog 34, which corresponds to the length of a stitch. The sewing speed may indicate the rotation speed of the drive shaft. In FIG. 6, for example, the sewing information with the identification number "0000" includes "stop" as the sewing pattern, "0(mm)" as the needle bar swinging amount, "0(mm)" as the cloth feed distance, and "0" as the sewing speed. Another piece of sewing information with identification number "0011" includes "straight stitch (left baseline)" as the sewing pattern, "0(mm)" as the needle bar swinging amount, "2.5(mm)" as the cloth feed distance, and "low speed: 70 rpm" as the sewing speed. Each row in the table of FIG. 6 may correspond to the sewing information stored in one dress pin 50.

The operator who intends to sew may prepare a required number of the dress pins 50, each of which stores desired sewing information. As described above, the sewing information has been stored beforehand in the memory section 826 of the RFID tag 800. For example, in order to form a straight stitch (left baseline) at a low speed, then form a zigzag stitch (middle baseline) with a needle bar swinging amount (stitch width) of 3.5 m at a high speed, and finally form a straight stitch (left baseline) at a low speed again and stop sewing, the operator may prepare a total of four dress pins 50, that is, two with identification number "0011", one with identification number "0023", and one with identification number "0000". By marking the surface of the head portion 51 of the dress pin 50 with the corresponding identification number, for example, the operator may easily identify the dress pin 50 that stores the desired sewing information. It may be identified even more easily by coloring the head portion 51 of the dress pin 50 differently for each of the sewing pattern, the needle bar swinging amount, the cloth feed distance, and the sewing speed. It may also be identified easily by differentiating the shape of the head portion 51 for each of the sewing pattern. The shape may be a polygon, a flower, a star, a sphere, etc. In order to store the sewing information into the memory section 826, writing processing may be performed by a known RFID writer or RFID reader/writer having a configuration similar to that of the above-described RFID reader 30.

Figure 7:
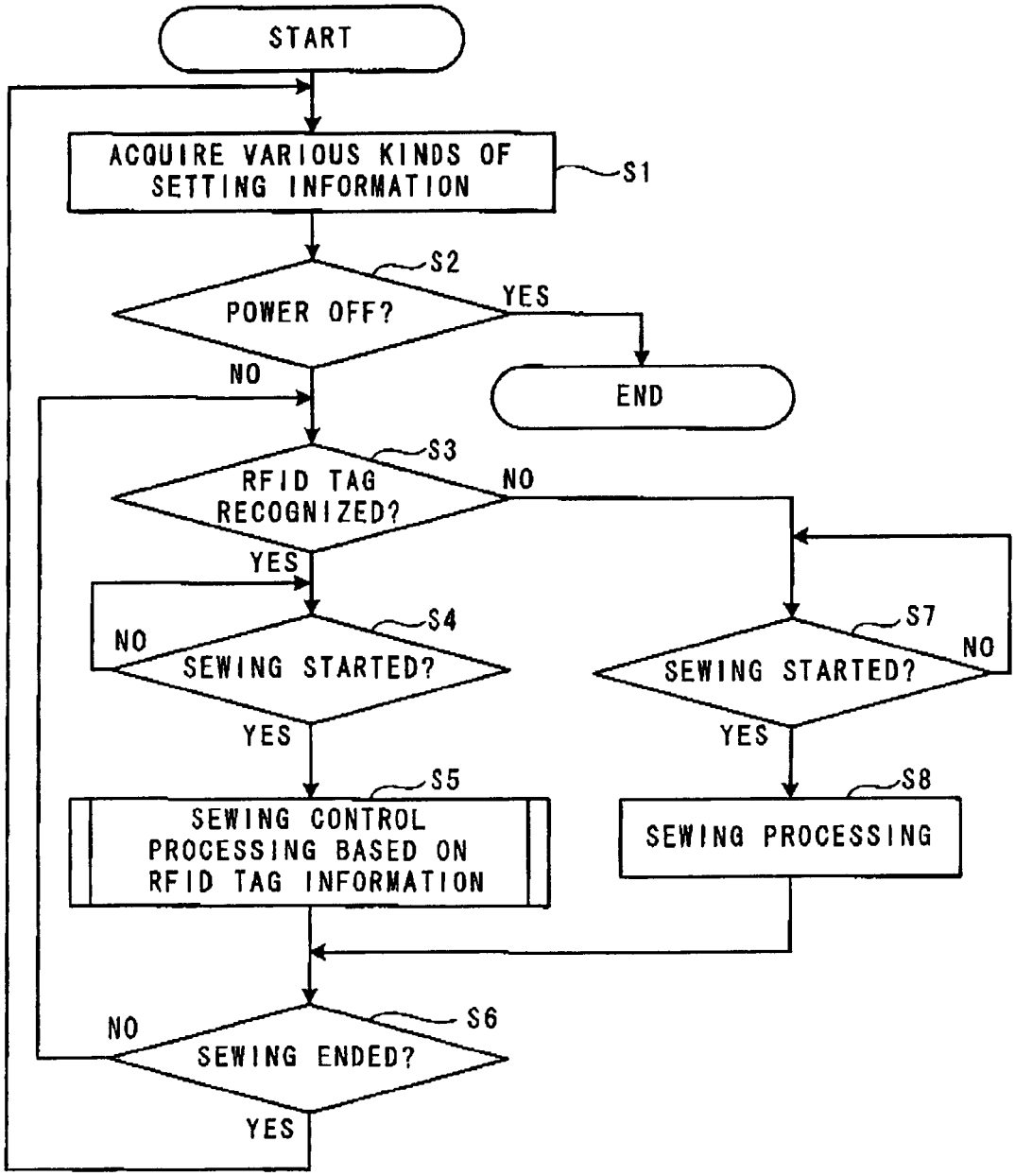
FIG. 7 is a flowchart of main processing of sewing which is performed in the sewing machine.
Figure 8:
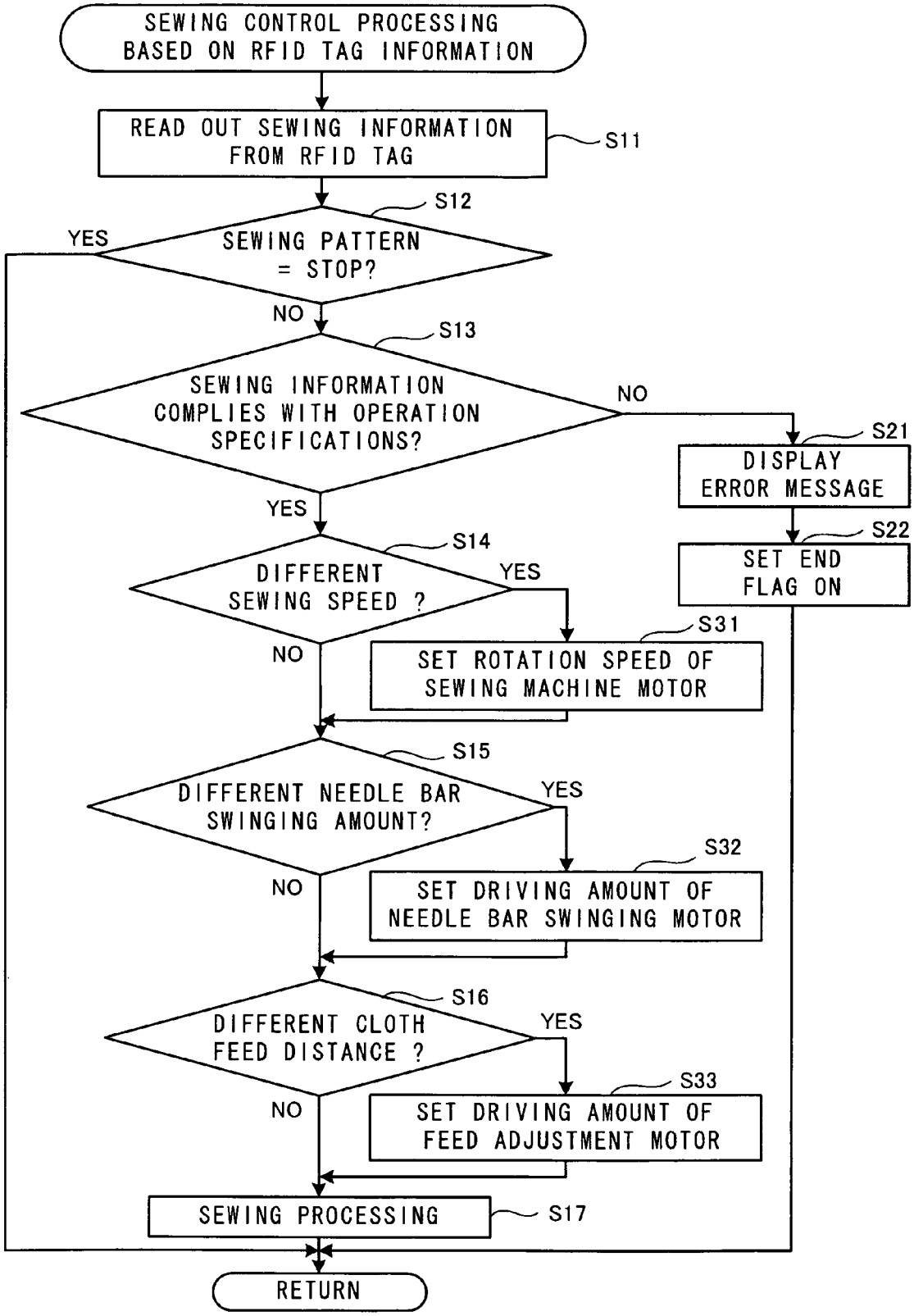
FIG. 8 is a flowchart of sewing control processing based on an RFID tag information that is performed during the sewing processing.
Figure 9:
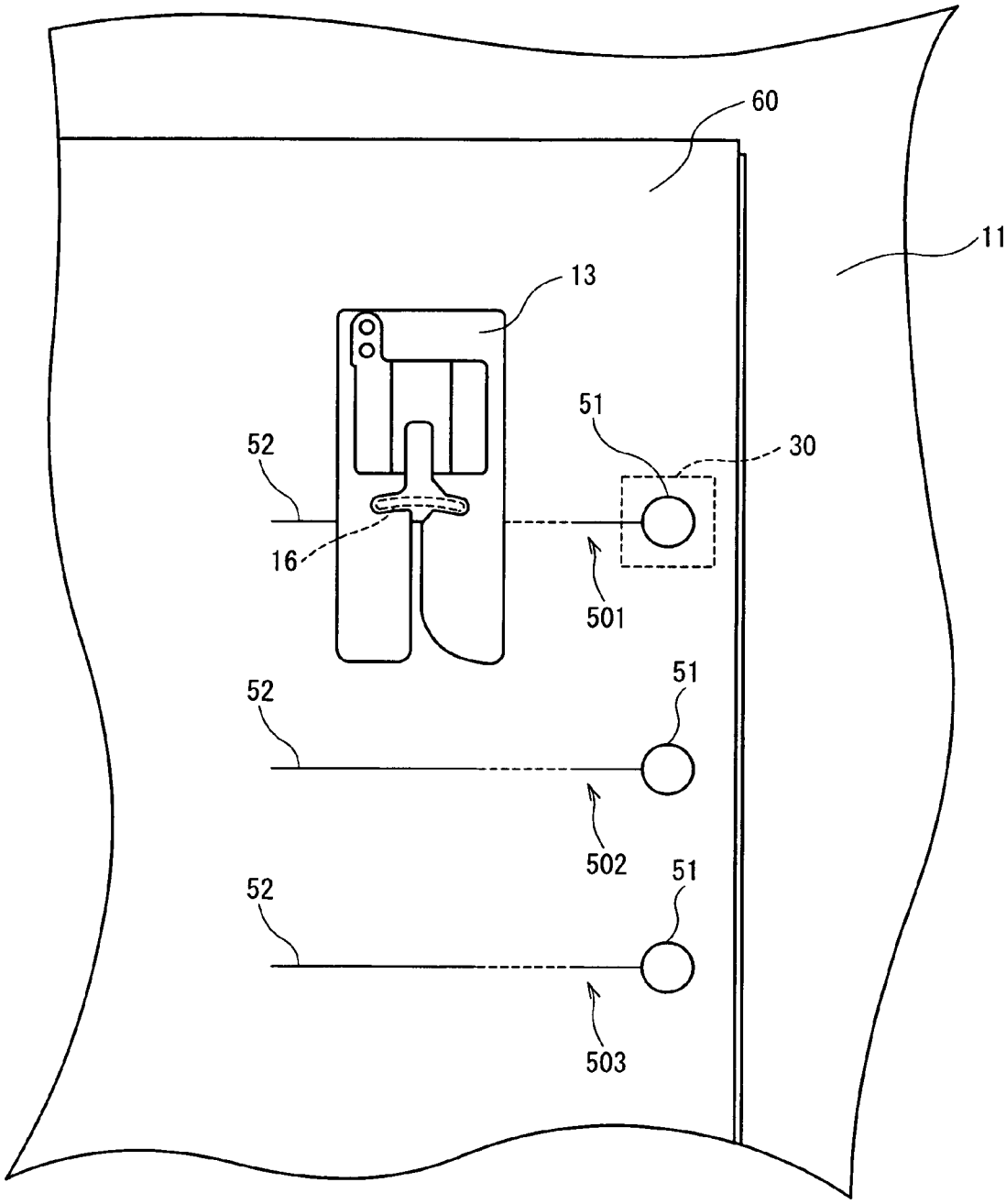
FIG. 9 is an explanatory illustration of a sewing procedure that uses the dress pin.

Next, a procedure for sewing a work cloth with the sewing machine 1 and dress pins 50 will be described below with reference to FIGS. 7 and 8. It is to be noted that the program for the processing shown in FIGS. 7-9 is stored in the ROM 102 and executed by the CPU 101 shown in FIG. 3.

First, main processing for sewing by the sewing machine 1 will be described below with reference to FIG. 7. The processing shown in FIG. 7 starts when a power switch (not shown) is turned ON. Following the start of the processing, the CPU 101 may initialize the sewing machine 1. Then, the CPU 101 may acquire various kinds of setting information which are entered, and store the acquired information in a setting information storage area (not shown) of the RAM 103 (S1). The various kinds of setting information may be entered via the touch panel 111 (see FIG. 3) of the LCD 10 (see FIG. 1) or the speed control lever 94 (see FIG. 1). For example, if a specific utility stitch pattern such as a "zigzag stitch" is selected on a setting screen displayed on the LCD 10, or if a sewing speed or a needle bar swinging amount for the zigzag stitch is set with the speed control lever 94, these pieces of information may be stored in the setting information storage area of the RAM 103. Then, the CPU 101 may determine whether the power switch (not shown) is turned OFF (S2). If the power switch is OFF (YES at S2), the main processing of FIG. 7 may terminate.

On the other hand, if the power switch is not turned OFF (NO at S2), the CPU 101 may determine whether the RFID tag 800 is recognized by the RFID reader 30 built in the needle plate 11 (S3). In an exemplary implementation, the communication range of the RFID reader 30 may be limited to cover only an area of roughly equal size of the RFID reader 30 as viewed in ground plan. Consequently, when the head portion 51 (the RFID tag 800) of the dress pin 50 is placed on the RFID reader 30, as shown in FIG. 9 as a dress pin 501, the RFID tag 800 may be recognized by the RFID reader 30. The communication range may be thus limited in order to avoid a risk that communication may be interfered when a plurality of RFID tags 800 have entered the communication range, thereby disabling reading of the sewing information in an appropriate order. As the work cloth 60 is gradually moved with a progress in sewing, the RFID tags 800 may enter the communication range over the RFID reader 30 one by one. Thus, the RFID reader 30 may communicate with only one of the RFID tags 800.

If the RFID tag 800 is recognized by the RFID reader 30 (YES at S3), the CPU 101 may determine whether it is instructed to start sewing (S4). Determination may be made on the basis of whether the sewing start/stop key 91 is pressed. If it is not instructed to start sewing (NO at S4), the CPU 101 may continue monitoring until it is instructed to start sewing (NO at S4). When the CPU 101 is instructed to start sewing (YES at S4), the CPU 101 may proceed to sewing control processing based on the RFID tag information (S5). The sewing control processing based on the RFID tag information will be described in detail later. After the sewing control processing based on the RFID tag information (S5) is started, the CPU 101 may determine whether it is instructed to end sewing (S6). Specifically, the CPU 101 may determine that it is instructed to end sewing (YES at S6) when any one of the following three cases applies. The first case is when the sewing start/stop key 91 is pressed again. The second case is when the sewing pattern included in the sewing information stored in the RAM 103 is data that indicates "stop". The third case is when an end flag has been set to "ON" in the sewing control processing based on the RFID tag information (S5). If the CPU 101 determines that it is instructed to end sewing (YES at S6), the process may return to the step of acquiring various kinds of setting information, to prepare for next sewing operations (S1). If the CPU 101 determines that it is not instructed to end sewing (NO at S6), the processing may return to the step of determining whether the RFID tag 800 is recognized (S3).

If the RFID tag 800 is not recognized by the RFID reader 30 (NO at S3), the CPU 101 may determine whether it is instructed to start sewing (S7). If the CPU 101 is not instructed to start sewing (NO at S7), the CPU 101 may continue monitoring until it is instructed to start sewing (NO at S7). If it is instructed to start sewing (YES at S7), the CPU 101 may perform sewing processing based on the setting information stored in the setting information storage area of the RAM 103 (S8). After the sewing processing, the CPU 101 may determine whether it is instructed to end sewing (S6). If the sewing start/stop key 91 is pressed again, the CPU 101 may determine that it is instructed to end sewing (YES At S6). Accordingly, to prepare for next sewing operations, the process may return to the step of acquiring the various kinds of setting information (S1). If the sewing start/stop key 91 is not pressed, the CPU 101 may determine that it is not instructed to end sewing (NO at S6) and the processing may return to the step of determining whether the RFID tag 800 is recognized (S3).

Next, sewing control processing based on RFID tag information, which is performed at S5 of the main processing shown in FIG. 7, will be described below with reference to FIG. 8. Following the start of the processing, the CPU 101 may read out the sewing information via the RFID reader 30 from the RFID tag 800 recognized at S3. The read-out sewing information may be stored in the tag information storage area (not shown) of the RAM 103 (S11). For example, the sewing information including an identification number of "0011" (see FIG. 6) is stored in the RFID tag 800 of the dress pin 50, which is placed in the communication range of the RFID reader 30. In this example, the CPU 101 reads out the sewing information with identification number "0011" from the RFID tag 800. Specifically, the CPU 101 reads out "straight stitch (left baseline)" as the sewing pattern, "0(mm)" as the needle bar swinging amount, "2.5(mm)" as the cloth feed distance, and "low speed: 70 rpm" as the sewing speed from the RFID tag 800. The read-out sewing information pieces may be stored in the corresponding areas of the tag information storage area of the RAM 103. After having acquired the sewing information (S11), the CPU 101 may determine whether the sewing pattern "stop", which indicates the end of sewing, is included in the sewing information stored in the tag information storage area (S12). If the sewing pattern "stop" is stored in the RAM 103 (YES at S12), the process may return to the main processing shown in FIG. 7. At S6 in the main processing, the CPU 101 may determine that it is instructed to end sewing (YES at S6), because the sewing pattern "stop" is stored in the RFID tag information storage area of the RAM 103, and the process may return to S1.

If the sewing pattern "stop" is not stored in the tag information storage area of the RAM 103 (NO at S12), the process may advance to S13. At S13, the CPU 101 may determine whether the sewing information stored in the tag information storage area of the RAM 103 complies with the operation specifications of the sewing machine 1 (S13). The operation specifications of the sewing machine 1 may be stored as basic information of the sewing machine 1 in a basic information storage area (not shown) of the ROM 102. The basic information may be referenced by the CPU 101 to make the determination. In an exemplary implementation, at S13, the CPU 101 may determine whether any information piece among the sewing pattern, the needle bar swinging amount, the cloth feed distance, and the sewing speed, which constitute the sewing information stored in the tag information storage area of the RAM 103, does not comply with the operation specifications of the sewing machine 1. For example, if a maximum value of the needle bar swinging amount is stored as "5 mm" in the basic information storage area of the ROM 102, and the needle bar swinging amount is stored as "7 mm" in the tag information storage area of the RAM 103, the CPU 101 may determine that the sewing information does not comply with the operation specifications (NO at S13). In this example, the CPU 101 may display an error message on the LCD 10 (S21). The error message may be, for example, "This sewing machine cannot perform sewing with a stitch width of 7 mm". Then, the CPU 101 may set the end flag stored in the predetermined area of the RAM 103 to "ON" (S22) and the process may return to the main processing shown in FIG. 7. Because the end flag stored in the RAM 103 is "ON", the CPU 101 may determine that it is instructed to end sewing (YES at S6) and the process may return to S1.

If it is determined at S13 that the sewing information stored in the tag information storage area of the RAM 103 complies with the operation specifications of the sewing machine 1 (YES at S13), the process may advance to S14. At S14, the CPU 101 may determine whether the sewing speed included in the sewing information stored in the tag information storage area of the RAM 103 is different from a currently set sewing speed (S14). The "currently set sewing speed" may refer to a sewing speed stored in the setting information storage area of the RAM 103. When the sewing control processing based on the RFID tag information shown in FIG. 8 is performed for the first time, a speed (e.g., low speed: 70 rpm) set with the speed control lever 94 has been acquired and may be stored in the setting information storage area of the RAM 103. On the other hand, if the sewing control processing based on the RFID tag information has already been performed, the sewing speed initially set by the speed control lever 94 may have been changed and the changed sewing speed may be stored. The sewing speed may be changed in the sewing control processing based on RFID tag information as described later. The needle bar swinging amount and the cloth feed distance may also be changed in the sewing control processing based on the RFID tag information. If having determined that the sewing speed read out from the RFID tag 800 is different from the currently set sewing speed (YES at S14), the CPU 101 may change the sewing speed stored in the setting information storage area of the RAM 103 to the sewing speed stored in the tag information storage area. Then, the CPU 101 may set the rotation speed of the sewing machine motor 77 in such a manner that the sewing speed equals to the changed sewing speed (S31). After setting the rotation speed of the sewing machine motor 77, the process may advance to S15.

If the sewing speed read out from the RFID tag 800 is the same with the currently set sewing speed (NO at S14), the process may advance to S15 without changing the setting of the rotation speed of the sewing machine motor 77. At S15, the CPU 101 may determine whether the needle bar swinging amount included in the sewing information stored in the tag information storage area is different from a currently set needle bar swinging amount stored in the setting information storage area (S15). A default value of the needle bar swinging amount may vary with the pattern to be sewn. The default values for respective patterns may be stored as basic information in the basic information storage area of the ROM 102. In the sewing machine 1, a pattern may be selected from the stored patterns via the touch panel 111 of the LCD 10. When the operator selects a desired pattern, the CPU 101 may reference the basic information storage area of the ROM 102 to acquire the default value of the needle bar swinging amount corresponding to the selected pattern, and may store it in the setting information storage area of the RAM 103 (S1). In addition, when a zigzag stitch is selected, the setting key displayed on the LCD 10 may be used to set the speed control lever 94 to operate as a swinging width adjustment lever, as described above. Then, the operator may set a desired needle bar swinging amount with the speed control lever 94. In such a case, the needle bar swinging amount set with the speed control lever 94 may be stored in the setting information storage area. Further, a driving amount for the needle bar swinging motor 78 (see FIG. 3) corresponding to the set needle bar swinging amount is also stored in the RAM 103. If having determined that the currently set needle bar swinging amount is different from the needle bar swinging amount read out from the RFID tag 800 and stored (YES at S15), the CPU 101 may change the needle bar swinging amount stored in the setting information storage area to the needle bar swinging amount stored in the tag information storage area. The CPU 101 may calculate and set a driving amount for the needle bar swinging motor 78 such that the needle bar swinging amount of the needle bar 8 equals to the changed needle bar swinging amount (S32). After setting the driving amount for the needle bar swinging motor 78, the process may advance to S16.

If it is determined that the currently set needle bar swinging amount is the same with the needle bar swinging amount read out from the RFID tag and stored (NO at S15), the process may advance to S16 without changing the driving amount for the needle bar swinging motor 78. At S16, the CPU 101 may determine whether the cloth feed distance included in the sewing information stored in the tag information storage area is different from the cloth feed distance stored in the setting information storage area (S16). A default value of the cloth feed distance may vary with the pattern to be sewn. The default values for the respective patterns may be stored as basic information in the basic information storage area of the ROM 102. If the operator selects a desired pattern via the touch panel 111 of the LCD 10, the CPU 101 may reference the basic information stored in the basic information storage area of the ROM 102 to acquire the needle bar swinging amount default value corresponding to the selected pattern, and may store it into the setting information storage area of the RAM 103 (S1). Further, a driving amount of the feed adjustment motor 76 (see FIG. 3) that corresponds to the set cloth feed distance may also be stored in the setting information storage area of the RAM 103. Therefore, if having determined that the currently set cloth feed distance is different from the cloth feed distance read out from the RFID tag 800 and stored (YES at S16), the CPU 101 may change the cloth feed distance stored in the setting information storage area of the RAM 103 to the cloth feed distance stored in the tag information storage area. Furthermore, the CPU 101 may calculate and set the driving amount for the feed adjustment motor 76 such that the distance fed by the feed dog 34 of the cloth feed mechanism equals to the changed cloth feed distance (S33). After setting the driving amount for the feed adjustment motor 76, the process may advance to S17. On the other hand, if it is determined at S16 that the currently set cloth feed distance is the same with the cloth feed distance read out from the RFID tag 800 and stored (NO at S16), the process may advance to S17 without changing the driving amount for the feed adjustment motor 76.

As described above, corresponding to the sewing information read out from the RFID tag 800, the rotation speed of the sewing machine 77, the driving amount for the needle bar swinging motor 78, and the driving amount for the feed adjustment motor 76 may be set appropriately. Then, the CPU 101 may control those motors to perform the sewing operation in accordance with thus set sewing information pieces (S17), and the process may return to the main processing shown in FIG. 7. As described above, when the sewing operation is performed on the basis of the sewing information read out from the RFID tag 800 (S17), the sewing pattern may not either be the data that indicates "stop" or the end flag is not "ON." Therefore, unless the sewing start/stop key 91 is pressed again, the CPU 101 may not determine that it is instructed to end sewing (NO at S6). Therefore, in such a case, the process may return to the step of determining whether the RFID tag 800 is recognized (S3). Then, the processing for sewing may be repeated (S3-S8) as described above. If power is turned OFF (YES at S2) after it is instructed to end the processing (YES at S6), the main processing may terminate.

An example of the sewing procedure will be described below with reference to FIG. 9. The example is directed to sewing procedure in which the sewing operator intends to form a straight stitch at a low speed first, then form a zigzag stitch (middle baseline) with a needle bar swinging amount of 3.5 mm at a high speed, and then end the sewing. In this example, all of the sewing information pieces comply with the operation specifications of the sewing machine 1. First, the operator prepares dress pins 501, 502, and 503, each storing sewing information having identification numbers "0011", "0023", and "0000" (see FIG. 6). The sewing information is stored in each of the RFID tags 800 of the dress pins 501, 502, and 503, as described above. Next, as shown in FIG. 9, the operator sticks the dress pin 501, in which the sewing information with identification number "0011" (straight stitch) is stored, into a pair of work cloths 60 to be sewn up. The pair of work cloths 60 is thus secured. The dress pin 501 is placed on the work cloths 60 in such a manner that the head portion 51 is located to the right side of a desired starting position of a straight stitch. Then, at a desired position where the straight stitch is to be stopped and changed to a zigzag stitch, the dress pin 502, in which the sewing information with identification number "0023" (zigzag stitch) is stored, is stuck into the work cloths 60. Further, at a desired ending position where the zigzag stitch is to be stopped to end sewing, the dress pin 503, in which the sewing information with identification number "0000" (stop) is stored, is stuck into the work cloths 60. In such a manner, the operator may temporarily secure the pair of work cloths 60 with the needle portions 52 of the respective dress pins 501-503. At the same time, the operator may specify a sewing start position and a sewing end position under desired sewing conditions with the head portions 51 of the respective dress pins 501-503.

Then, the operator places the pair of work cloths 60, into which the dress pins 501-503 are stuck, on the needle plate 11 of the bed 2. At this time, the head portion 51 of the dress pin 501 is located on the RFID reader 30. If power for the sewing machine 1 is ON (NO at S2 in FIG. 7), the CPU 101 recognizes the RFID tag 800 of the dress pin 501 via the RFID reader 30, because it is in the communication range of the RFID reader 30 (YES at S3 in FIG. 7). If the operator presses the sewing start/stop key 91 at this time (YES at S4), the sewing information with identification number "0011" stored in the RFID tag 800 of the dress pin 501 is read out (S11 in FIG. 8). Then, the sewing information currently stored in the sewing information storage area of the RAM 103 may appropriately be changed to the sewing information with identification number "0011" (S12-S16 and S31-S33 in FIG. 8). Then, the sewing machine motor 77, the needle bar swinging motor 78, and the feed adjustment motor 76 are controlled to form a straight stitch on a left baseline, with a needle bar swinging amount of 0 mm and a cloth feed distance of 2.5 mm at a low speed (70 rpm) (S17 in FIG. 8). The pair of work cloths 60 is fed upward in FIG. 9 while being sewn up with a straight stitch (NO at S6 in FIG. 7). Consequently, the dress pin 502 comes up onto the RFID reader 30, and the RFID tag 800 of the dress pin 502 is recognized by the RFID reader 30 (YES at S3 in FIG. 7). Then, the sewing information with identification number "0023" stored in the RFID tag 800 of the dress pin 502 is read out (S11 in FIG. 8). Then, a zigzag stitch on a middle baseline is formed, with a needle bar swinging amount of 3.5 mm and a cloth feed distance of 1.4 mm at a high speed (750 rpm) (S12-S17 and S31-S33 in FIG. 8). The pair of work cloths 60 is fed further upward in FIG. 9 while being sewn up with a zigzag stitch (NO at S6 in FIG. 7). When the dress pin 503 comes up onto the RFID reader 30, the RFID tag 800 of the dress pin 503 is recognized by the RFID reader 30 (YES at S3 in FIG. 7). Then, the sewing information with identification number "0000" stored in the RFID tag 800 of the dress pin 503 is read out (S11 in FIG. 8). Because the sewing information with identification number "0000" indicates a sewing pattern "stop" (YES at S12 in FIG. 8), the CPU 101 determines that it is instructed to end sewing (YES at S6) and the processing returns to the step of acquiring various kinds of setting information (S1). If the operator turns the power OFF (YES at S2), the main processing terminates.

As described above, by utilizing a dress pin 50 having an RFID tag 800 storing sewing information in its head portion 51, it is possible for an operator to temporarily secure a pair of work cloths 60 to be sewn and also specify a sewing start position and a sewing end position under desired sewing conditions. Then, in the sewing machine 1, sewing operation is controlled in accordance with the sewing information read out from the RFID tag 800 by the RFID reader 30. Therefore, even if the sewing operator is a beginner who is not skilled in sewing, the operator may easily form desired stitches by simply feeding the work cloths 60 along the dress pins 50. Furthermore, changing the sewing speed and stopping sewing at an appropriate timing, which may be difficult for a beginner, may be enabled by simply sticking the dress pins 50 storing the corresponding sewing information to desired positions.

The sewing machine of the present disclosure is not limited to the sewing machine 1 in the above-described implementations, and various modifications may be made without departing from the scope of the present disclosure. For example, in the above example, the RFID tag 800, from which the sewing information is read out by the RFID reader 30 of the sewing machine 1, may be provided in the dress pin 50. The mark or the sewing mark may also be formed as a seal. The following will describe sewing control processing by use of a seal 55 according to an alternative implementation with reference to FIGS. 10 and 11.

Figure 10:
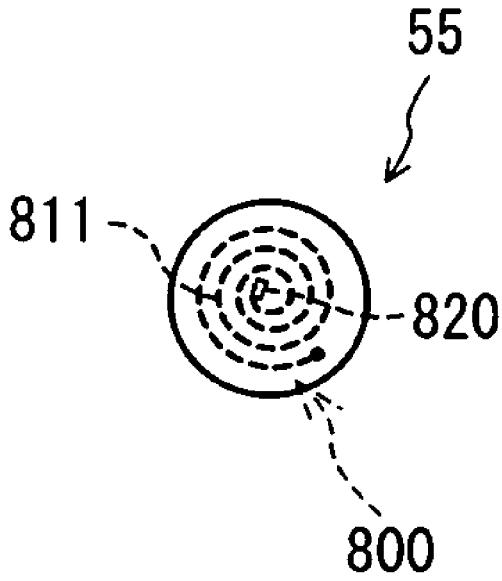
FIG. 10 is a plan view of a seal according to an alternative implementation.
Figure 11:
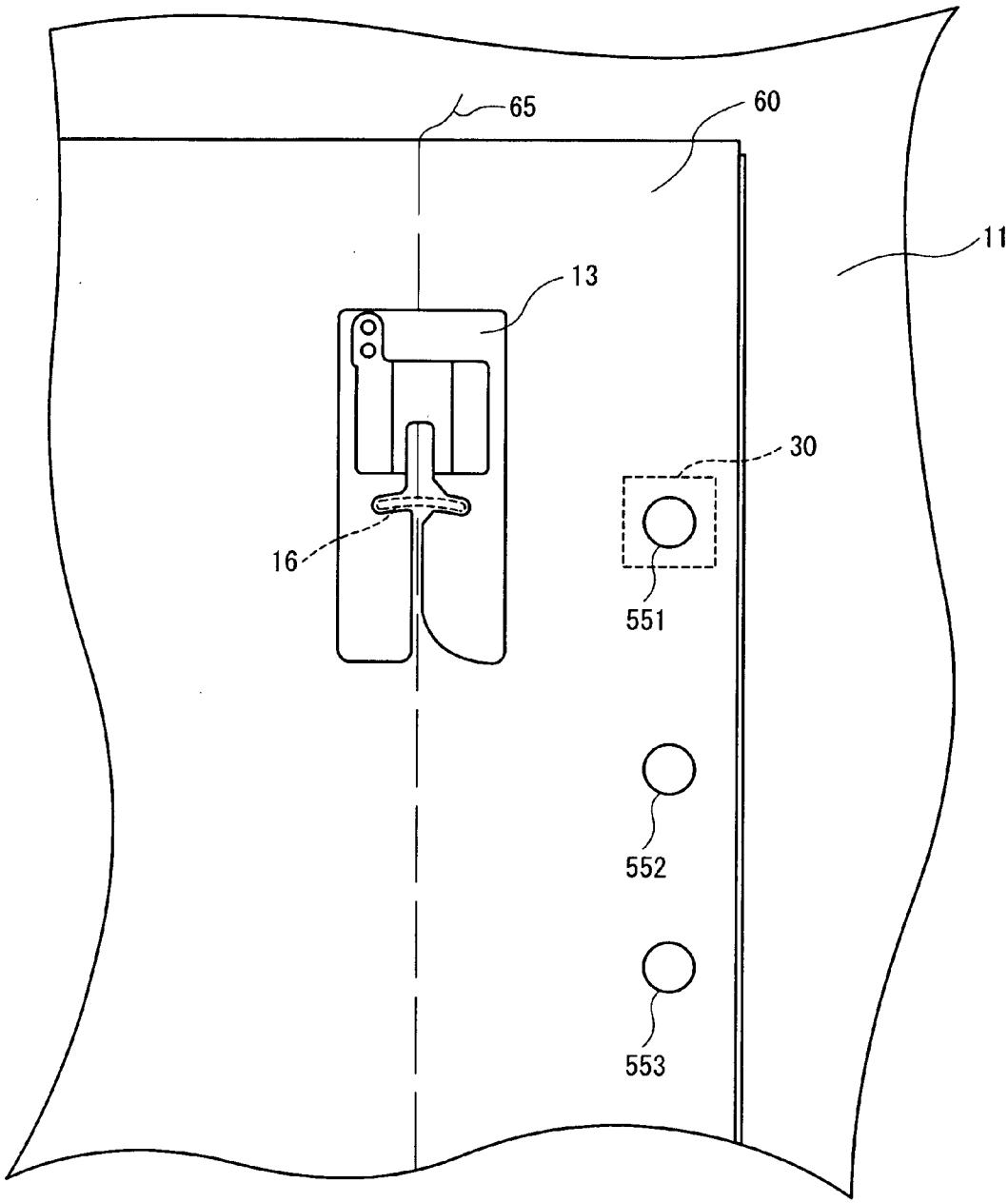
FIG. 11 is an explanatory illustration of the sewing procedure by use of the seal.

As shown in FIG. 10, the seal 55 may have a structure in which the above-described RFID tag 800 is sandwiched between two stacked resin sheets (not shown), which are roughly circular in shape as viewed in ground plan. On an outer surface of one of the two stacked resin sheets, an adhesive layer may be formed (not shown). Therefore, by sticking the seal 55 onto a work cloth with the adhesive layer, it may be possible to specify a position where sewing is started or stopped in accordance with desired sewing conditions in much the same way as with the above-described dress pin 50. The seal 55 may be marked with an identification number on a surface as in the case of the above-described dress pin 50, so that the operator may easily identify the seal 55. For example, before actual sewing, the operator may prepare seals 551-553, each of which has an RFID tag 800 storing the desired sewing information. As shown in FIG. 11, the operator may stick the seals 551-553 onto desired positions where sewing is started or ended in accordance with the respective stored sewing information. Then, after a pair of work cloths 60 is set to the sewing machine 1, the sewing information may sequentially be read out by the RFID reader 30 from the RFID tags 800 of the respective seals 551-553 in much the same way as with the above-described dress pin 50. The sewing machine motor 77, the needle bar swinging motor 78, and the feed adjustment motor 76 may be controlled in accordance with the read out sewing information. When using the seal 55, which does not have the needle portion 52 unlike the dress pin 50, there may be an advantage that it is easy for an operator to handle the seals 55. On the other hand, the pair of work cloths 60 may not be temporarily secured when being sewn up with the seals 55. Therefore, apart from the seals 55, the pair of work cloths 60 may be temporarily secured with a basting thread 65 along a sewing path, on which stitches are to be formed with a sewing needle.

In the above examples, the RFID reader 30 may be fitted in the needle plate 11. Other than that, the RFID reader 30 may be disposed at another position as far as sewing may be controlled by sequentially communicating with the RFID tags 800 provided to the respective dress pins 50 in the vicinity of the needle hole 16, where the sewing needle drops (a needle drop position). For example, the RFID reader 30 may be placed on the upper surface of the bed 2, attached to the presser foot 13 or the presser bar 14, etc.

The above-described exemplary and alternative implementations may respectively employ the dress pin 50 and the seal 55 as an example of the mark having the RFID tag 800. The mark, however, is not limited to these forms. For example, a safety pin, etc., may be employed as the mark as far as it may be attached to a work cloth as an eyemark. Further, in the above implementation, the head portion 51 of the dress pin 50 and the seal 55 may be shaped roughly circular as viewed in plan view. The shape of the mark, however, is not limited to a particular shape and may be any shape as long as the mark may include the RFID tag 800. For example, a polygon, a flower, or a star may be employed for both the dress pin 50 and the seal 55. A sphere may be employed for the dress pin 50. The head portions 51 of the dress pins 50 and the seals 55 may be colored differently with the different sewing patterns, needle bar swinging amounts, cloth feed distances, and sewing speeds, so that they may be identified easily.

As described above, the sewing machine of the present disclosure may sequentially communicate with an RFID tag in a mark, which is attached beforehand to a work cloth to be sewn, read out sewing information stored in the RFID tag, and control sewing based on the read out sewing information. Therefore, a person engaged in sewing may attach the marks that have the RFID tag storing the desired sewing conditions to a sewing position where a stitch is to be formed on the work cloth, to thereby perform sewing in accordance with the desired sewing conditions by simply feeding the work cloth following the marks. Therefore, even a beginner unfamiliar with sewing with the sewing machine may form a desired stitch without having to stop sewing halfway, for example, to change the sewing conditions. Further, by storing sewing information that indicates stoppage of sewing in the RFID tag, sewing may be stopped at an appropriate timing.

According to the sewing machine control program of the present disclosure, the sewing information stored in the RFID tag in a mark attached to a work cloth may be read out, and sewing may be controlled based on the sewing information read out from the RFID tag. Therefore, a person engaged in sewing may attach the marks having the RFID tag storing desired sewing conditions to sewing positions of the work cloth, to thereby perform sewing in accordance with the desired sewing conditions by simply feeding the work cloth following the marks. Therefore, even a beginner of the sewing machine unfamiliar with sewing with the sewing machine may easily form desired stitches without having to stop sewing halfway, for example, to change the sewing conditions. Further, by storing sewing information that indicates stoppage of sewing in the RFID tag, sewing may easily stopped at an appropriate timing.

The sewing mark of the present disclosure may easily used for a sewing machine that includes an information reading device that reads out information stored in the RFID tag and a control device that controls sewing based on the information read out by the information reading device. The sewing mark of the present disclosure may include an attachment member and an RFID tag. The attachment member may be attached to and detached from a work cloth to be sewn. The RFID tag stores at least sewing information. Therefore, a person engaged in sewing may attach the sewing marks having desired sewing information stored in its RFID tag as an eyemark of a sewing position, to thereby perform sewing in accordance with the desired sewing conditions with the sewing machine by simple feeding the work cloth following the sewing marks. Therefore, even a beginner unfamiliar with sewing with the sewing machine may be form desired stitches without having to stop sewing halfway, for example, to change the sewing conditions. Further, by storing sewing information that indicates stoppage of sewing in the RFID tag, sewing may be stopped at an appropriate timing.

What is claimed is:

1. A sewing machine comprising:

a needle bar to which a sewing needle is attached;

a sewing machine motor that drives a needle bar mechanism for vertically driving the needle bar via a drive shaft;

an information reading device that is disposed in the vicinity of a needle drop position of the sewing needle and that reads out sewing information related to sewing conditions for the sewing machine each time a mark attached to a work cloth enters into a communication range of the information reading device as the work cloth is moved, the sewing information being stored in an RFID tag included in the mark; and a control device that controls sewing based on the sewing information read out by the information reading device from the RFID tag.

2. The sewing machine according to claim 1, further comprising:

a needle bar swinging motor that drives a needle bar swinging mechanism for transversely swinging the needle bar; and a feed adjustment motor that adjusts a feed distance of a cloth feed mechanism for feeding the work cloth placed on a sewing machine bed by a predetermined feed distance, wherein:

the sewing information includes at least one of sewing speed data, a needle bar swinging amount data, and a feed distance data, the sewing speed data relating to a rotation speed of the drive shaft, the needle bar swinging amount data relating to a moving amount in a transverse direction of the sewing needle swung by the needle bar swinging mechanism, and the feed distance data relating to the feed distance of the work cloth fed by the cloth feed mechanism; and the control device controls at least one of the sewing machine motor, the needle bar swinging motor, and the feed adjustment motor based on the sewing information.

3. The sewing machine according to claim 1, wherein the mark is a dress pin having a head portion and a needle portion.

4. The sewing machine according to claim 1, wherein the mark is a label-shaped seal, the mark having an adhesive layer on a surface of the seal.

5. A computer-readable recording medium storing a sewing machine control program for a sewing machine, the sewing machine including a needle bar to which a sewing needle is attached and a sewing machine motor that drives via a drive shaft a needle bar mechanism for vertically driving the needle bar, and the program comprising:

instructions for reading out sewing information relating to sewing conditions for the sewing machine each time a mark attached to a work cloth enters into a communication range as the work cloth is moved, the sewing information being stored in an RFID tag included in the mark; and instructions for controlling sewing based on the sewing information read out from the RFID tag.

6. The computer-readable recording medium according to claim 5, wherein:

the sewing machine further includes:

a needle bar swinging motor that drives a needle bar swinging mechanism for transversely swinging the needle bar; and a feed adjustment motor that adjusts a feed distance of a cloth feed mechanism for feeding the work cloth placed on a sewing machine bed by a predetermined feed distance;

the sewing information includes at least one of sewing speed data, a needle bar swinging amount data, and a feed distance data, the sewing speed data relating to a rotation speed of the drive shaft, the needle bar swinging amount data relating to a moving amount in the transverse direction of the sewing needle swung by the needle bar swinging mechanism, and the feed distance data relating to the feed distance of the work cloth fed by the cloth feed mechanism; and the instructions for controlling controls at least one of the sewing machine motor, the needle bar swinging motor, and the feed adjustment motor based on the sewing information.

7. The computer-readable recording medium according to claim 5, wherein the mark is a dress pin having a head portion and a needle portion.

8. The computer-readable recording medium according to claim 5, wherein the mark is a label-shaped seal, the mark having an adhesive layer on one surface of the seal.

9. A sewing mark to be used for sewing with a sewing machine, the sewing machine including an information reading device that is disposed in the vicinity of a needle drop position of a sewing needle and that reads out sewing information stored in an RFID tag in a communication range of the information reading device and a control device that controls sewing based on the sewing information read out by the information reading device, the sewing mark comprising:

an attachment member that may be attached to and detached from a work cloth to be sewn; and an RFID tag that stores at least the sewing information relating to sewing conditions for the sewing machine, wherein the sewing information includes at least one of sewing speed data, a needle bar swinging amount data, and a feed distance data, the sewing speed data relating to a rotation speed of a drive shaft, the needle bar swinging amount data relating to a moving amount in the transverse direction of the sewing needle, and the feed distance data relating to the feed distance of the work cloth.

10. The sewing mark according to claim 9, wherein the sewing mark is a dress pin having a head portion and a needle portion, the needle portion being the attachment member.

11. The sewing mark according to claim 9, wherein the sewing mark is a label-shaped seal, the mark having an adhesive layer on one surface of the seal, the adhesive layer being the attachment member.

* * * * *